US005898955A

United States Patent [19]

Thompson

[11] Patent Number: 5,898,955

[45] Date of Patent: May 4, 1999

[54] RETRACTABLE TOILET ARRANGEMENT

[76] Inventor: Geneva E. Thompson, 3043 Lynrose Dr., Anaheim, Calif. 92804

[21] Appl. No.: 09/073,208

[22] Filed: May 4, 1998

[51] Int. Cl.[6] ..... E03D 1/00

[52] U.S. Cl. ..... 4/300; 4/312; 4/661

[58] Field of Search ..... 4/662, 300, 312, 4/420, 661

[56] References Cited

U.S. PATENT DOCUMENTS

| | | | |
|---|---|---|---|
| 2,428,462 | 10/1947 | Levin | 4/312 |
| 3,166,767 | 1/1965 | Jewell | 4/10 |
| 3,992,727 | 11/1976 | Elkins | 4/10 |
| 4,944,047 | 7/1990 | Gagliano | 4/312 |
| 5,577,753 | 11/1996 | Pociask | 280/250.1 |
| 5,765,237 | 6/1998 | Okamoto et al. | 4/312 |

*Primary Examiner*—David J. Walczak
*Attorney, Agent, or Firm*—Goldstein & Canino

[57] ABSTRACT

A stowable and deployable toilet arrangement provides a moveably configured toilet that may be deployed by a user, used, and subsequently stowed into an alcove until next required for use. The toilet includes a discharge port for discharging wastes from the toilet. The discharge port is coupled by an extendible discharge tube that is coupled to a suitable waste receiving repository such as a cesspool or a sewer system. A friction reducing arrangement is included to enable the toilet to be easily rolled from a stowed position to a deployed position, and visa versa. The toilet arrangement may also include a linear actuator to automatically deploy or stow the toilet when a user activates a switch.

5 Claims, 3 Drawing Sheets

RETRACTABLE TOILET ARRANGEMENT

BACKGROUND OF THE INVENTION

1. Field of the Invention

The present invention relates toilet fixtures, and more particularly, the invention relates to a slidably mounted, stowable, and possibly aesthetically concealable toilet arrangement.

2. Background and Objects of the Invention

The standard restroom, say in a residential setting, includes at least one sink or basin, a shower or a tub, and usually a toilet. When constructed in a small sized room, a bathroom can quickly become cluttered with the essential fixtures, leaving little room for an occupant (or occupants) to maneuver. Accordingly, the utility of recessed or retractable fixtures, which can be 'tucked-away' or 'stowed', will alleviate some of the (room) congestion, and possibly aesthetically improve the appearance of a room.

When considering prior art 'space saving' devices, a typical device is provided by U.S. Pat. No. 4,944,047 to Gagliano. A plurality of 'foldable' wall/niche mounted fixtures are disclosed by this reference. These devices provide one with alternative solutions to using standard, common restroom fixtures, especially in a very small room. However, the desire to employ standard, or near standard fixtures, which can be used in conventional rest and bath rooms, is not satisfied by the Gagliano fixtures. Further, it may be desirable to be able to convert or alter a currently owned toilet for use with the present invention—which is not possible with devices such as those suggested by Gagliano.

When considering the prior art in general, there is currently lacking a simple and cost effective solution to implementing a stowable or retractable toilet. Objects of the present invention are, therefore, to provide new and improved stowable and deployable toilet arrangements having one or more of the following capabilities, features, characteristics, and/or advantages:

- simple embodiments of a toilet assembly that may utilize a standard toilet therein;
- employs extendible discharge and inlet tubes coupling the toilet to a waste receiving (repository) means and a supply of pressurized water, respectively;
- easily constructable using many available parts;
- includes a friction reducing means, such as rollers that are suitably positioned around a base of the toilet, that enable a toilet or toilet assembly to be easily deployed, used, and returned to a stowed position;
- may include a linear actuator assembly and user accessible switch to automatically deploy and stow the toilet; and
- having a simple low cost construction.

The above listed objects, advantages, and associated novel features of the present invention, as well as others, will become more clear with a careful review of the description and figures provided herein. Attention is called to the fact, however, that the drawings and the associated description are illustrative only, and variations are certainly possible.

SUMMARY OF THE INVENTION

In accordance with the present invention a stowable and deployable toilet arrangement comprises a moveably configured toilet that may be deployed by a user, used, and subsequently stowed (when not needed). The terms 'deploy' or 'deployed' will indicate the toilet is positioned and ready for use. While the term 'stowed' will indicate that the toilet is retracted, recessed in an alcove, and or more generally unavailable for use.

The toilet (or toilet assembly) will provide a discharge port for discharging wastes from the toilet and an inlet port for the coupling of a source of pressurized water to the toilet. Extendible tubes are coupled to the discharge port and the inlet port that enable each to be continuously coupled, as required, while the toilet (or toilet assembly) is deployed or stowed, or transitioning from one of these positions to another.

A friction reducing means is included to enable the toilet to be one of rolled forward and deployed for use and rolled backward and stowed (in a rearwardly located alcove) when not being used. Alternately, the toilet may be arranged to be moveable from side to side, wherein the toilet is stowed in an alcove to the side of the toilet.

A preferred embodiment of the toilet arrangement of the present invention includes at least one linear actuator to automatically deploy and stow the toilet or toilet assembly when a user activates a switch. The linear actuator may be arranged with an electric motor that may be energized to deploy the toilet by a person activating the switch, and later may be re-energized to stow the toilet with a second press of the switch.

BRIEF DESCRIPTION OF THE DRAWINGS

In the drawings, like elements are assigned like reference numerals. The drawings are not necessarily to scale, with the emphasis instead placed upon the principles of the present invention. Additionally, each of the embodiments depicted are but one of a number of possible arrangements utilizing the fundamental concepts of the present invention. The drawings are briefly described as follows.

LIST OF REFERENCE NUMERALS USED IN THE DRAWINGS

10—toilet arrangement
12—toilet or toilet assembly
12*a*—toilet tank
16—base
18*a*—first or stowed position
18*b*—second or deployed position
20—discharge port
20*a*—discharge tube segment
20*b*—discharge tube segment
22—(extendible) discharge tube
22*a*—first end (of discharge tube)
22*b*—second end (of discharge tube)
24—inlet port
26—(extendible) inlet tube
28—rollers
30—switch (or pushbutton)
34—linear actuator
36—control module

DETAILED DESCRIPTION OF THE PREFERRED EMBODIMENTS

Figure 1:
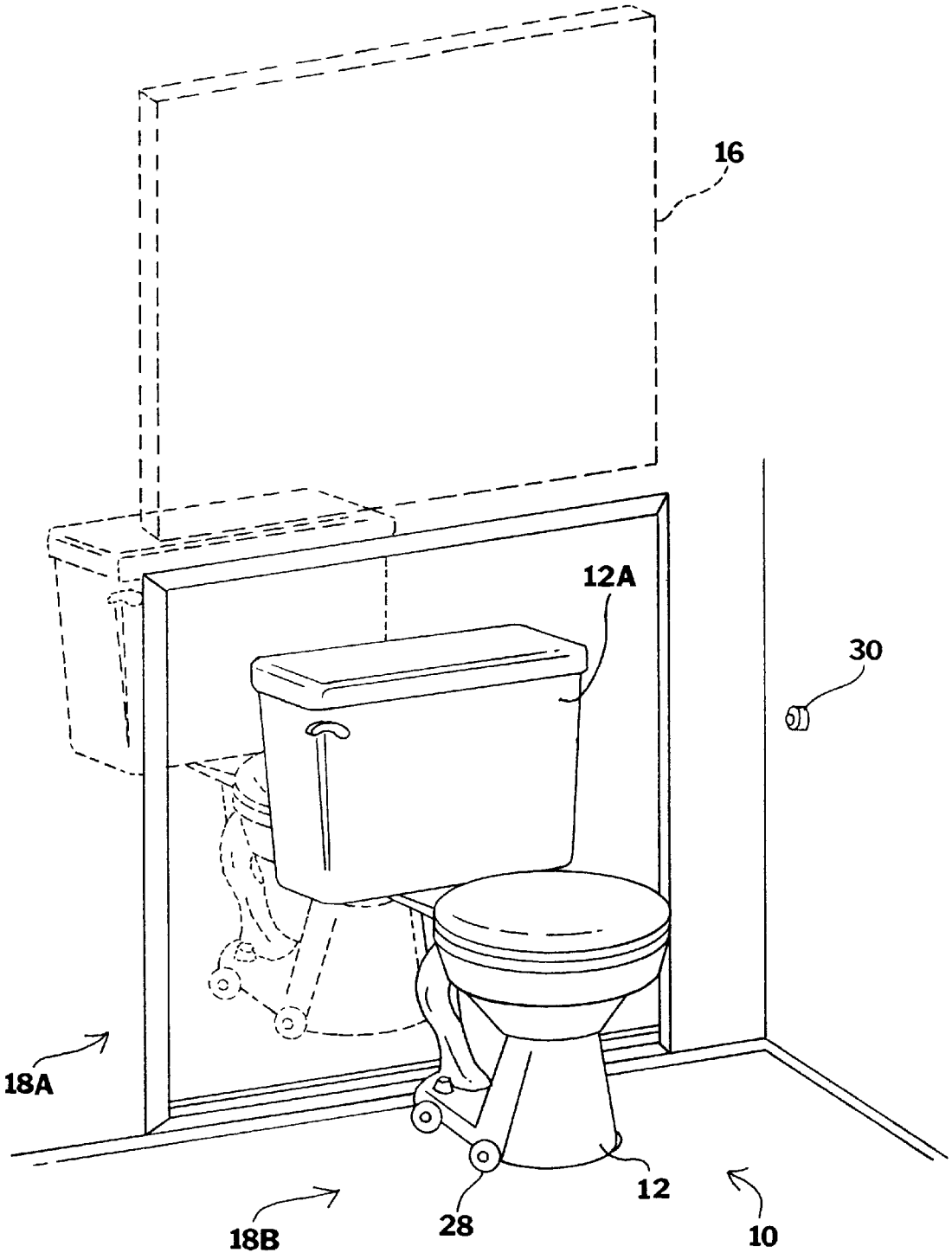
FIG. 1 provides a perspective view of an embodiment of a retractable and stowable toilet arrangement of the present invention.

Turning now to FIG. 1, there is shown an embodiment of a stowable (retractable) and deployable toilet arrangement 10. As can be seen, the toilet 12 may be positioned in a stowed or retracted position 18*a*, when not is use, or a deployed position 18*b*, wherein the toilet is available for use. As such, when the unsightly toilet 12 is not in use, it may be stowed in an alcove, and preferably aesthetically covered by one or more doors 16, or a functionally equivalent structure. For example, as shown if FIG. 1, the door 16 may be arranged to lift when the toilet 12 is deployed, and may possibly include counterweights (which are not explicitly shown).

Figure 2:
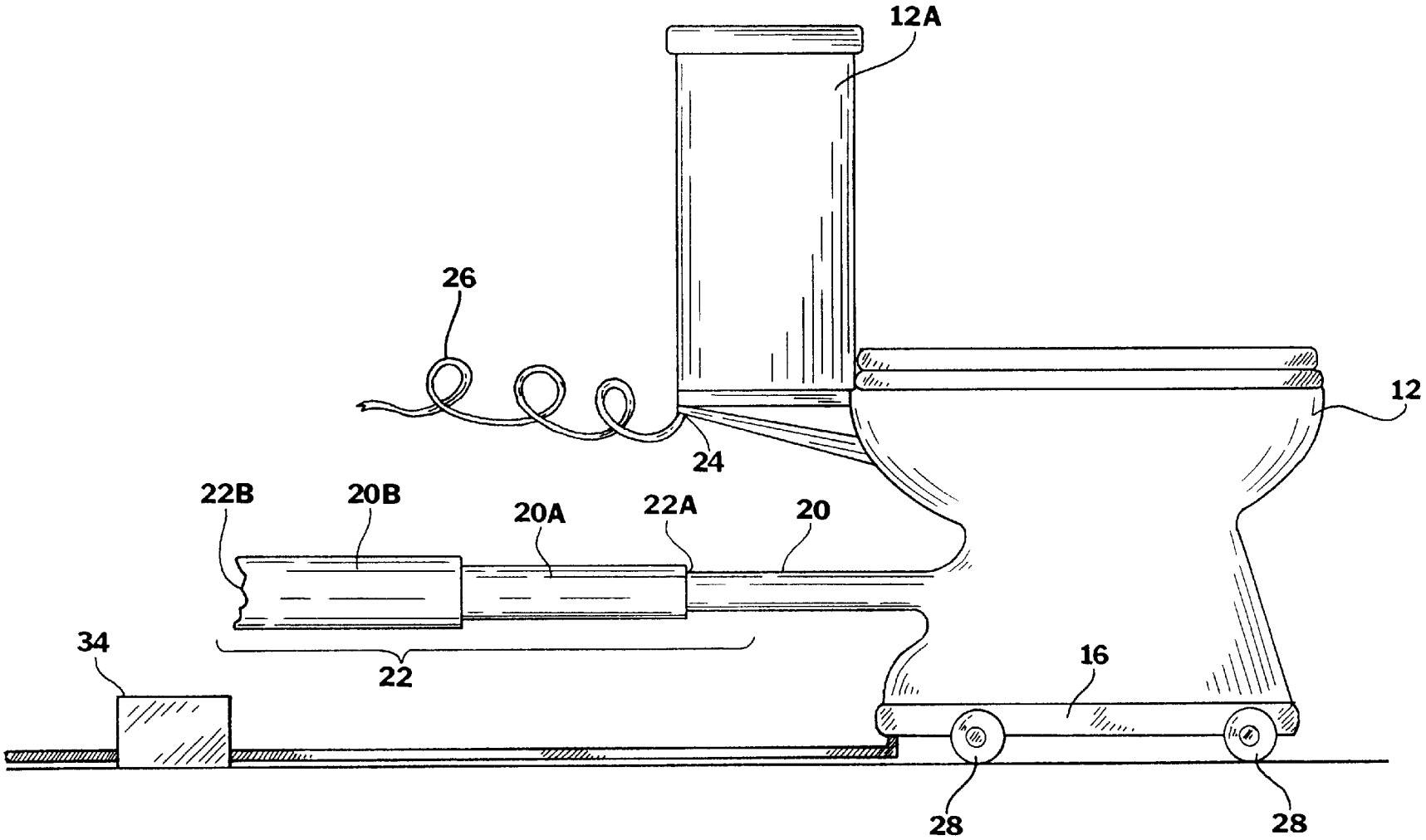
FIG. 2 provides a side view of an embodiment of the toilet arrangement configured with a telescoping discharge tube, and shown in a deployed position.

The toilet 12 is configured with a discharge port 20 for discharging waste from the toilet. The discharge port 20 would preferably by arranged to exit the toilet 12 rearwardly, as can be seen in FIG. 2, or to a side (not explicitly shown). A discharge tube 22, which may be termed 'an extendible discharge tube' or 'a telescoping discharge tube', is included to couple to the discharge port 20 of the toilet 12 to pass (liquid and or solid) waste discharged from the toilet 12 to a suitable 'discharge location', which may also be termed a 'waste repository'. The discharge tube 22 may accordingly be described as having a first end 22*a* and a second end 22*b*. Wherein the first end 22*a* is coupled to the discharge port 20 of the toilet 12 to accept wastes discharged from the toilet. While the second end 22*b* couples the waste material (passing through the discharge tube) to a suitable waste receiving means. Examples of suitable waste receiving or discharge receiving locations may include one or more of septic or cesspool tanks, a sewer system, a waste processing plant, and equivalents. As can be seen in FIG. 2, the discharge tube 22 may be embodied by a plurality of sections, such as discharge tube segments 20*a* and 20*b*, having graduated diameters, wherein one respective section or segment fits and slides into another respective section, thereby forming the extendible discharge tube that is telescopic in nature.

As required by virtually all toilets, an inlet port 24 will enable a source of pressurized water to be coupled to the toilet 12. The actual pressurized water source may be coupled to the toilet 12 by any suitable arrangement that will provide "an extendible inlet tube". The extendible inlet tube 26, such can be seen in FIG. 2, will enable the toilet 12 to be deployed and stowed while continually coupled to the source of pressurized water. It should be noted that the water toilet tank 12*a* may not be required if a sufficient diameter inlet tube 26, possibly larger than depicted in FIG. 2, is employed.

To enable the toilet 12, or a toilet assembly including the toilet 12, to be movable between a stowed or retracted position 18*a* and the deployed position 18*b*, a friction reducing means is required. Accordingly, an arrangement including, for example, rollers 28 may be employed to enable the toilet 12 rolled forward and backward, or alternately, from side to side (not illustrated). The plurality of rollers 28 may be rotatably fixed about a lower portion of the toilet 12 to enable the toilet to be easily rolled within a small area (i.e., when deployed or stowed). As shown in FIG. 2, a base 16 may be included to enable the rollers 28 to be suitably coupled to the toilet 12. Accordingly, a 'toilet assembly' may be composed of the toilet 12, the base 16, and other included items. The coupling of the rollers 28, or equivalent friction reducing means, is realized at 'a lower portion of the toilet', near the supporting surface which the toilet or toilet assembly contacts. As skilled persons would appreciated, many friction reducing means and arrangements, may be provided to realize this functional requirement of the invention—some simple and others being quite complicated. All such embodiments of these arrangements are considered to be within the scope of the claimed invention.

The toilet 12 or an equivalent toilet assembly may be stowed into, and deployed from, a volume of space establishing what may be termed an 'alcove', a recess, or the like. The alcove would be located adjacent to and one of behind the toilet 12 (utilized with forward and backward movement) or on a side of the toilet (for side to side movement). As such, the toilet 12 may be deployed from the alcove, used, flushed, and stowed back into the alcove until next needed. Thus, the unsightly and space consuming toilet 12 may be stowed for aesthetic as well as utilitarian purposes.

Figure 3:
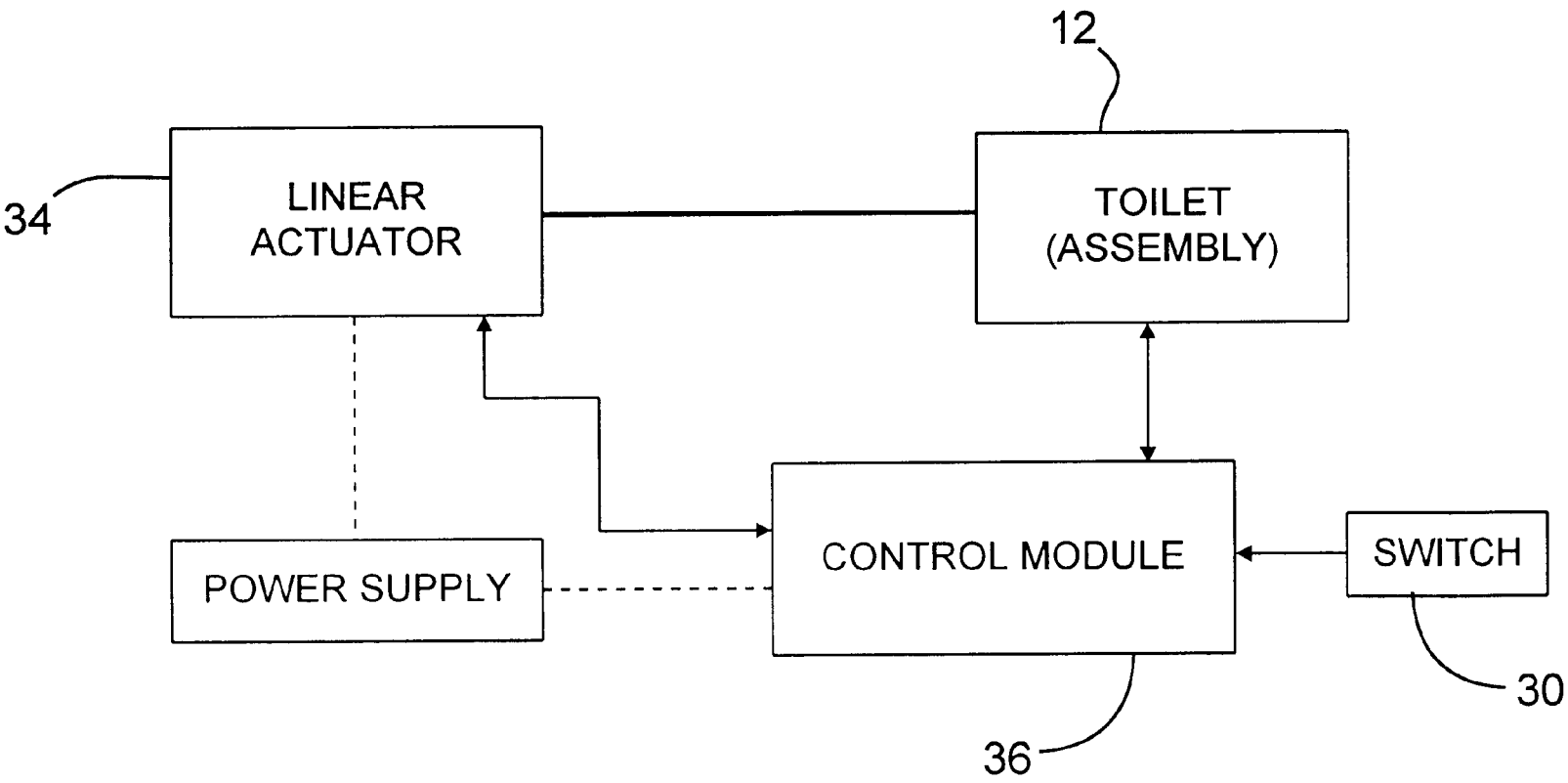
FIG. 3 is a block diagram of an electromechanical system to support the automatic switch-activated stowing and deploying of a toilet assembly of the invention.

In order to support automatic or motor controlled deployment and stowing of the toilet 12, a linear actuator 34, as shown in FIGS. 2 and 3, may be included with preferred embodiments of the invention. For example, well known linear actuators are available that include electric motors to drive a threaded actuator rod. When such devices or functional equivalents are employed, a switch 30 may be provided for a user to activate and energize the linear actuator 34. The switch 30 may be directly coupled to the linear actuator 34, or alternately, coupled indirectly via a control module 36, to deploy or stow the toilet 12. In a preferred embodiment, a user would activate the switch 30 once to deploy the toilet 12, and later may stow the toilet with a second press of the switch 30.

The block diagram of FIG. 3 provides a simple exemplary embodiment to support the automatic operation of the toilet arrangement 10 of the invention. The linear actuator 34 is mechanically coupled to the toilet 12, preferable at a lower point close to a floor of the supporting surface. A control module 36 may be provided as an embedded system or a functionally equivalent hard-logic system, which is preferably arranged with the switch 30 operatively coupled to the control module. The switch 30 may be suitably situated to enable a user of the toilet 12 to activate the switch to indicate to the control module 36 that the toilet is to be deployed or stowed. Skilled individuals may furnish other functionally equivalent embodiments of the block diagram and apparatus of FIG. 3, possibly including safety and other sensing devices, and the like.

The provision of extendible tubes enables the toilet 12 to be continually coupled to discharge and inlet services when the toilet 12 is either deployed or stowed. A possibly most preferred embodiment provides an extendible discharge tube 22 as being formed of a plurality of sections of graduated diameters, wherein one respective section fits into and slides into another respective section. Skilled persons will appreciate such a structure will require sealing means, such as o-rings, washers, and the like, to prevent leaking of waste materials from the discharge tube (and sections thereof). This architecture of the discharge tube 22 may be referred to as 'a telescoping kind of a structure' or equivalently 'telescopic' in nature. When considering a preferred embodiment of the inlet supply tube 26, a coiled flexible pressure tubing may be preferred. Skilled persons will understand that a variety of extendible coupling configurations are possible.

It is important to understand that the description of the embodiments of the toilet arrangement of the present invention are illustrative only, and other equivalent arrangements are certainly possible. Therefore, while there have been described the currently preferred embodiments of the present invention, those skilled in the art will recognize that other and further modifications may be made without departing from the present invention, and it is intended to claim all modifications and variations as fall within the scope of the appended claims.

What is claimed is:

1. A stowable and deployable toilet arrangement, comprising:

a) a toilet having a discharge port for discharging wastes from the toilet and an inlet port for the coupling of a source of pressurized water to the toilet;

b) friction reducing means to enable the toilet to be one of rolled forward and deployed for use and rolled backward and stowed when not being used, comprises a plurality of rollers that are rotatable fixed about a lower portion of the toilet to enable the toilet to be rolled within a small area;

c) an extendible discharge tube coupled to the discharge port of the toilet to accept and pass wastes discharged from the toilet to a suitable discharge repository; and d) an extendible inlet tube to couple the source of pressurized water to the inlet port of the toilet;

e) a linear actuator included and suitable coupled to the toilet to enable automatic deploying and stowing of the toilet;

f) the toilet stowed in and deployed from a volume of space providing an alcove located adjacent to and one of:

i) behind the toilet; and ii) on a side of the toilet;

g) wherein the toilet may be deployed from the alcove, used, flushed, and stowed back into the alcove until next needed.

2. The toilet arrangement according to claim 1, wherein the linear actuator includes an electric motor that may be energized to deploy the toilet by a person activating a switch, with the toilet later stowed by a second press of the switch.

3. The toilet arrangement according to claim 2, wherein at least one door is provided to aesthetically cover the alcove when the toilet is stowed therein.

4. A retractable and stowable toilet arrangement wherein a toilet may be deployed from an alcove, used, and returned to the alcove until again needed, the toilet arrangement comprising:

a) a toilet assembly including a toilet having a discharge port for discharging wastes from the toilet and an inlet port for the coupling of a source of pressurized water to the toilet;

b) a plurality of rollers that are rotatably fixed at spaced locations about a lower portion of the toilet assembly to contact a surface upon which the toilet assembly is placed to enable the toilet assembly to be rolled in one of either a forward/back direction and a side to side direction, the rollers provided to enable a user to cause the toilet assembly to be rolled out of the alcove and deployed, used, and subsequently rolled back into the alcove and stowed;

c) an extendible discharge tube having a first end and a second end, the first end coupled to the discharge port of the toilet to accept wastes discharged from the toilet and pass the wastes to a suitable waste receiving means, which is coupled to the second end of the discharge tube;

d) an extendible inlet tube to couple the source of pressurized water to the inlet port of the toilet for use in flushing the toilet; and e) means to deploy and stow the toilet assembly including a linear actuator functionally coupled thereto, which is included to enable the automatic deploying and stowing of the toilet;

f) the toilet stowed in and deployed from a volume of space providing the alcove located adjacent to and one of either behind the toilet or on a side of the toilet, wherein the toilet may be deployed from the alcove, used, flushed, and stowed back into the alcove until the next use.

5. The toilet arrangement according to claim 4, wherein the linear actuator includes an electric motor that may be energized to deploy the toilet assembly by a person activating a switch, and later may be again energized to stow the toilet via a second press of the switch.

* * * * *